US005083951A

United States Patent [19]

Baba

[11] Patent Number: 5,083,951

[45] Date of Patent: Jan. 28, 1992

[54] ENGINE CONTROL APPARATUS FOR MARINE USE

[75] Inventor: Masanao Baba, Takarazuka, Japan

[73] Assignee: Nippon Cable System Inc., Takarazuka, Japan

[21] Appl. No.: 578,930

[22] Filed: Sep. 7, 1990

[51] Int. Cl.[5] ..... B63H 21/28

[52] U.S. Cl. ..... 440/86; 440/87

[58] Field of Search ..... 440/53, 84, 85, 86, 440/87, 88

[56] References Cited

U.S. PATENT DOCUMENTS 4,119,186 10/1978 Choudhury et al. .

FOREIGN PATENT DOCUMENTS 53-107094 9/1978 Japan .
56-108389 8/1981 Japan .
59-114197 7/1984 Japan .
137098 6/1988 Japan ..... 440/86
52591 2/1989 Japan ..... 440/86

*Primary Examiner*—Jesus D. Sotelo
*Assistant Examiner*—Stephen P. Avila
*Attorney, Agent, or Firm*—Armstrong, Nikaido, Marmelstein, Kubovcik & Murray

[57] ABSTRACT

An engine control apparatus for marine use comprising an operating plate which is driven by pushing/pulling operation through a cam attached to a driving disc, a transmission link which is arranged so as to extend in the moving direction of the operating plate and to be movable in the direction, and moreover, which is driven by pushing/pulling operation according to the operation of a free throttle lever, and a throttle arm which is connected to the transmission link at a first rotation center and connected to the top end of the operating plate at a second rotation center which is apart from the first center of rotation. In the device, when a throttle is operated through the operating plate, the throttle arm rotates around the first center of rotation, and on the other hand, when the throttle is operated through the free throttle lever, the throttle arm rotates around the second center of rotation.

3 Claims, 6 Drawing Sheets

ENGINE CONTROL APPARATUS FOR MARINE USE

BACKGROUND OF THE INVENTION

The present invention relates to an engine control apparatus for marine use, and more particularly, to an apparatus for controlling both engine revolution (throttle control) and change of "ahead(forward)"-"neutral"-"astern(reverse)" (clutch control) of a small craft or boat, for example motorboat and so on, which are remotely operated by a single operational lever in a cockpit.

As a conventional engine control apparatus for marine use, there has been known a device shown in Japanese Unexamined Patent Publication No. 114197/1984.

In the device, as shown in FIG. 6 for example, when a driving disc 52 supported with an axis on a housing 51 is rotated by means of an operational lever 53 in a certain domain (a certain angular range) including neutral position, only a clutch arm 54 rotates and a change operation of "ahead"-"neutral"-"astern" of a clutch is performed through a clutch operation cable 55 (including a cable end rod, and so forth).

Further, when the driving disc 52 is rotated over the above-mentioned domain, only a throttle arm 56 rotates and power of the engine is governed through a throttle operational cable 57. In this case, when the throttle cable 57 is pushed, the engine is accelerated. That is, the engine is a "push-type-engine". However, the device is designed such that the device can also be applied to a "pull-type-engine" which is accelerated when the throttle cable 57 is pulled.

When the device is applied to a "pull-type-engine", an operating plate 61 which has a cam roller 60 engaged with a cam groove 59 of the above-mentioned driving disc 52 is removed, the inside of the plate 61 is turned out, and is attached to the device again. And further, the plate 61 is pin-jointed to another engaging hole 62 of the throttle arm 56.

Therefore, in the above-mentioned conventional device (Japanese Unexamined Patent Publication No. 114197/1984), when the device adapted for a push-type-engine (or a pull-type-engine) is applied to a boat having another type engine i.e. the pull-type-engine (the push-type-engine), the work of re-assembling is very troublesome.

Further, the device of FIG. 6 has a free throttle lever 63 for independently operating the throttle when the operating lever 53 is in the neutral position.

That is, a link 64 is laid between the free throttle lever 63 and the throttle arm 56 so as to rotate around a pin 67, and an arc-shaped cam groove 65 is formed in the link 64.

The cam groove 65 slidably receives a cam roller 66 fixed to the top end of the free throttle lever 63, and the cam roller 66 engages with the cam groove 65 with, so to speak, linear-contact. Therefore, a disadvantageous abrasion occurs in the contacting part. Moreover it is necessary to rotate widely the operating plate 61, when the engine is accelerated through the free throttle lever 63. Therefore, there are some problems that the mechanism is complicated, and assembling and adjusting works and maintenance of the mechanism are troublesome.

The object of the present invention is to provide an engine control apparatus for marine use, in which the same operability as the above-mentioned conventional device is held, mechanism is simple, and assembling and adjusting and maintenance are easy.

Another object of the present invention is to provide a device which can be easily applied to a different type of engine, i.e. an engine having a different operating direction of a throttle cable.

SUMMARY OF THE INVENTION

The engine control apparatus of the present invention comprises an operating plate, a transmission link, and a throttle arm. The operating plate is driven by pushing-/pulling operation through a cam which is attached to a driving disc. The transmission link extends in a moving direction of the operating plate and is movable in the same direction. Moreover, the link is driven by pushing-/pulling operation according to the operation of the free throttle lever.

The throttle arm is connected to a top end or the neighborhood of the transmission link (a first rotation center), and is further connected to the top end or the neighborbood of the operating plate (a second rotation center). When a throttle is operated through the operating plate, the throttle arm rotates around the first rotation center, and on the other hand, when the throttle is operated through the free throttle lever, the throttle arm rotates around the second rotation center.

In the apparatus as mentioned above, during a general run, the free throttle lever is in the idling position and the throttle arm is rotated such that the first rotation center serves as a fulcrum.

On the contrary, when the engine is operated in order to warm up, the throttle arm is rotated such that the second rotation center serves as another fulcrum. That is to say, the first and second rotation centers perform as a force point and a fulcrum of a lever altenately in accordance with situation.

Since, in the above-mentioned operations, the contact portion is only the rotating surface of the pin joints, durability of a rotating mechanism portion of the free throttle arm is improved, and a total mechanism of the device becomes simple.

Further, in the motions of the transmission link and the operating plate, rotating motion is fundamentally not required. In addition, for example, if a structure allowing some vertical motions of the operating plate is employed, the operating plate can be formed as a member linearly moving in the housing. In such case, the mechanism of the device becomes more simple, and the motion of the throttle arm becomes more smooth. And besides, during the rotation of the throttle arm, the throttle cable sweeps less degrees in swing angle.

In addition, when the driving disc has two types of cams, i.e. a cam for pull-type-engine and another cam for push-type-engine, and both cams are formed in the same driving disc such that the cams are opposed to each other, the device can be easily applied to not only a pull-type-engine but also a push-type-engine by changing a cam roller position of the operating plate and by changing a connecting position between the rotating link and the transmission link.

DETAILED DESCRIPTION

Figure 1:
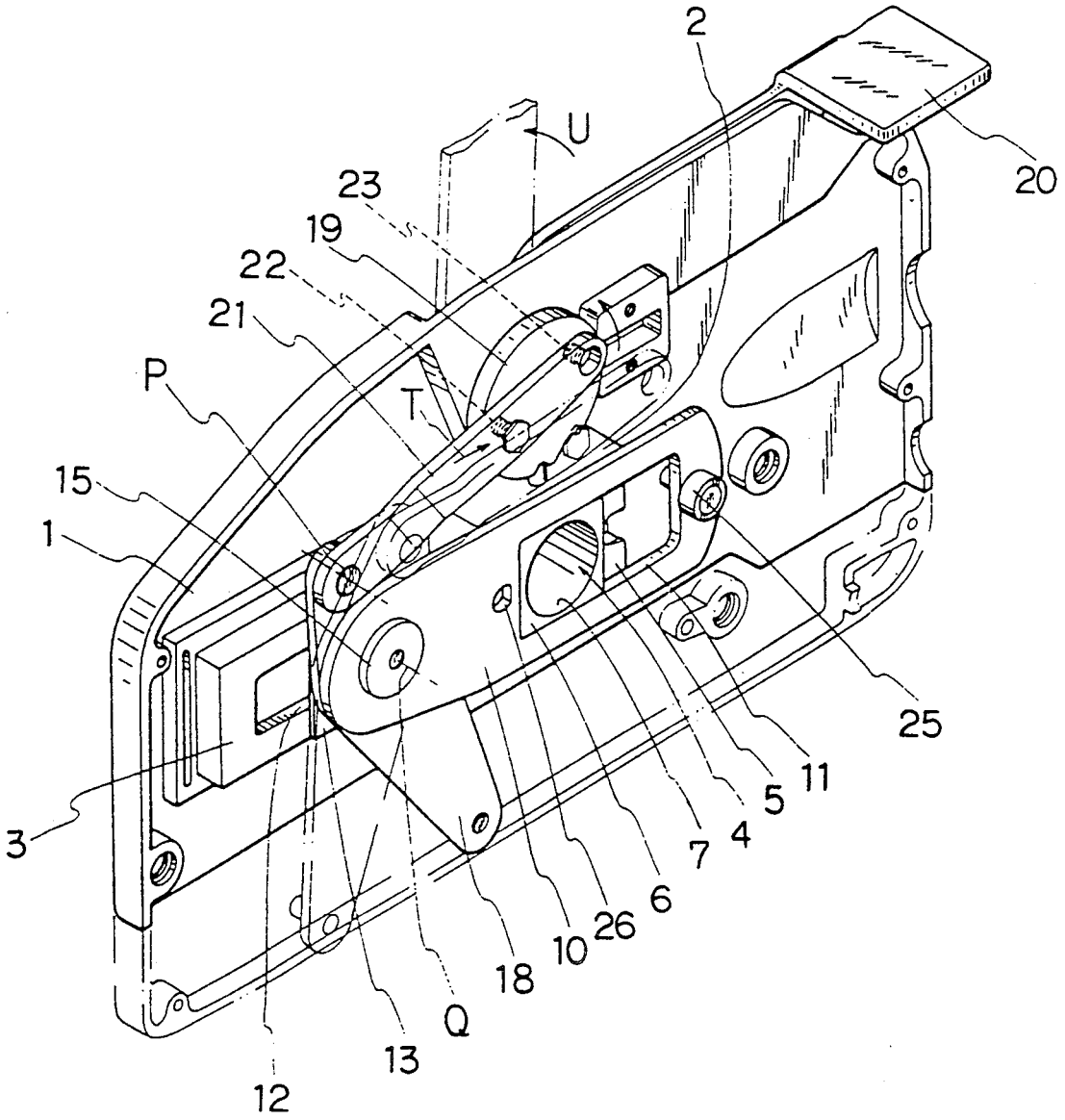
FIG. 1 and FIG. 2 are perspective views showing a housing cover side and a housing body side, respectively, of an embodiment of the device of the present invention.

Referring to FIG. 1, a cover-side half body of an engine control apparatus is explained.

A housing cover 1 has two projecting block-like guides portions 2 and 3, i.e. a main guide 2 and a secondary guide 3.

The main guide 2 has a shaped hole 4 at the center or the neighborhood thereof. A guide bush 6 made of bearing metal or synthetic resin is securely inserted into the hole 4, and the guide bush 6 has a joggled flange with a rectangular shape to be engaged with the outer surface of the main guide 2. The guide bush 6 also has a cylindrical hole with an inner surface 7 for rotatably supporting a boss 9 of a driving disc 8 of FIG. 2.

An operating plate 10 is mounted on the guide bush 6 in a slidable state. That is to say, the inside parallel edges of the rectangular hole 11 of the operating plate 8 and the reverse surface of the operating plate 10 are engaged with the peripheral surface and the front surface of the joggled flange 5 in a slidable state. Therefore, the operating plate 10 can be guided with the guide bush 13 so as to linearly slide in a longitudinal direction of the rectangular hole 11.

A sliding bush 13 having a flange is slidably engaged with another rectangular hole 12 formed in the secondary guide 3. Further, the operating plate 10 has a flanged pin 15 inserted through a hole formed in the forward end portion and is projected to the reverse side of the plate 10, and the flanged pin 15 is connected to the sliding bush 13.

Therefore, by means of both guide portions 2 and 3, the linear motion of the operating plate 10 is certainly retained with a long span over the right side and left side.

A throttle arm 18 is attached rotatably around the above-mentioned pin 15, and is sandwitched between the sliding bush 13 and the operating plate 10.

In an upper side of the above-mentioned main guide portion, a disc-like rotating link 19 is rotatably attached to the housing cover 1. The rotating link 19 is fixed to the base part or the axis of the free throttle lever 20 such that the rotating link is rotated together with the free throttle lever 20 arranged on the outside of the housing cover. Two screw holes 22 and 23 are formed in order to selectively attach a transmission link 21. The two positions are symmetrical with respect to the rotation center of the rotating link 19.

Further, in case of FIG. 1, another end of the transmission link 21 is pin-jointed to the hole located in the upper end of the throttle arm 18. An end of the transmission link 21 is pin-jointed concentrically with the screw hole 22 located in the fore side of the rotating link 19. Therefore the transmission link 21 is arranged almost parallel to the operating plate 10, and the transmission link 21 and the operation plate 10 are constructed in an parallel arrangement in mechanism so as to move in almost the same direction. The operating plate 10 has two holes 26 and 27 for selectively attaching a cam roller 25 to be engaged with the cam groove of the driving disc 8. The attaching holes 26, 27 are arranged on the both sides of the rectangular hole 11 of the operating plate 10. In case of FIG. 1, the cam roller 25 is attached to an attaching hole 27 (referring to FIG. 5) located in the aft side.

Hereinafter, construction of the main body side of the housing is explained referring to FIG. 2.

A driving disc 8 is rotatably mounted in the central portion 28 of the housing and is connected to the operational lever 29 which is located in the outside of the main body 28 of the housing, such that the driving disc 8 is rotated through the lever 29.

Two cam grooves each of which has a "C" like shape 30 and 31 are formed in the driving disc 8 on the opposite sides with respect to the boss 9 so as to oppose to each other. Each cam groove 30 and 31 has a rest zone Ro with an arc shape of which a center is the rotating center of the driving disc 8 and operating zones Rf and Rr which extend from the both ends of the rest zone in a circumferential direction with somewhat inward to the center of rotation i.e. as the operating zone extends from the end of the rest zone, the operating zone extends inner side in the radial direction. One operating zone Rf is made to be long or than the other in order that the engine can be operated to the full throttle state i.e. the operating zone for "ahead (forward)", and another operating zone Rf is for "astern (reverse)".

Figure 4:
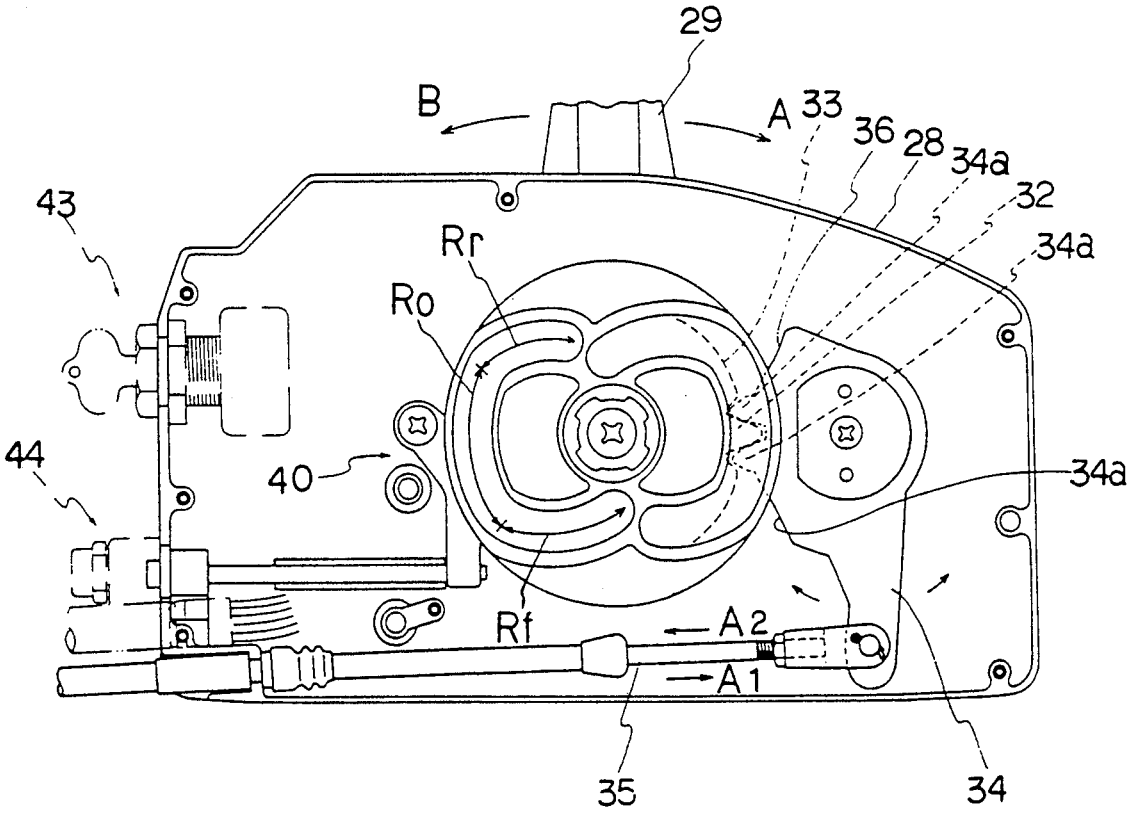

The back side of the driving disc 8 is provided with one tooth 32 and a slidably contacting portion with a cylindrical slidable surface 33 as a one body as shown with a broken line in FIG. 4. The tooth 32 and the slidable surface 33 construct a clutch operating mechanism together with two teeth 34*a* and a inwardly curved slidable surface 36 formed in the position opposing a clutch arm 34 rotatably mounted on the main body 28 of the housing, and the both cooperate to perform the clutch mentioned after operation which is the same as the conventionally known operation.

Figure 2:
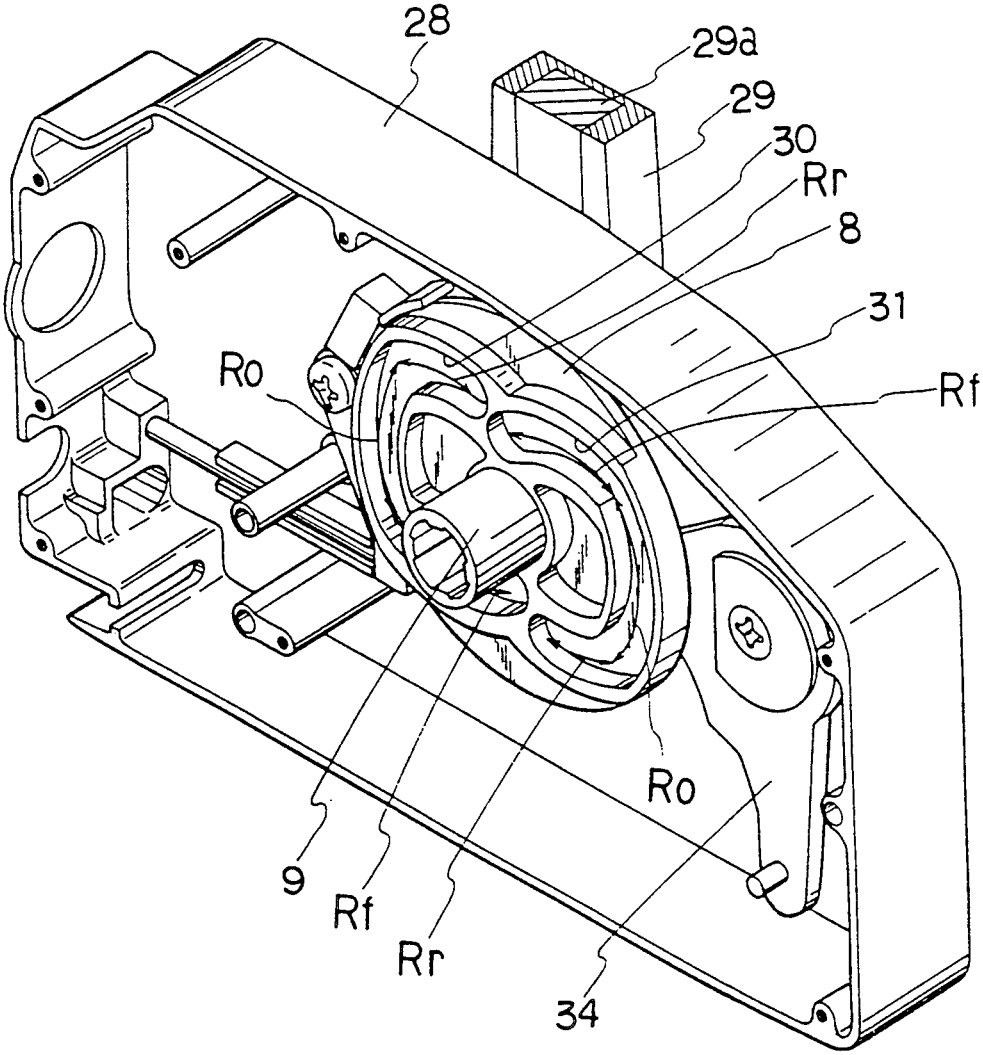

The two halves of FIG. 1 and 2 are mately superposed in such state that the cam roller 25 is engaged with the cam groove 30 of the driving disc 8, and are assembled with using screws or the like.

Hereinafter, operation of the device constructed as mentioned above is explained referring to FIGS. 3 and 4.

Firstly, the clutch operation is explained referring to FIG. 4.

When the operational lever 29 points just "upper side", the clutch arm 34 points "down side" which is the "neutral" position on account of an engagement of teeth 32, 34*a*. Next, when the operational lever 29 is turned forward (in an arrow A direction), the down end of the clutch arm 34 rotates forward on account of an engagement of teeth 32, 34*a*, and the clutch cable 35 is pulled in an arrow A1 direction to chang the clutch into "ahead".

On the contrary, when the operational lever 29 is turned in an arrow B direction, the clutch arm 34 rotates backward and the clutch cable 35 is pulled in an arrow A2 direction.

Figure 3:
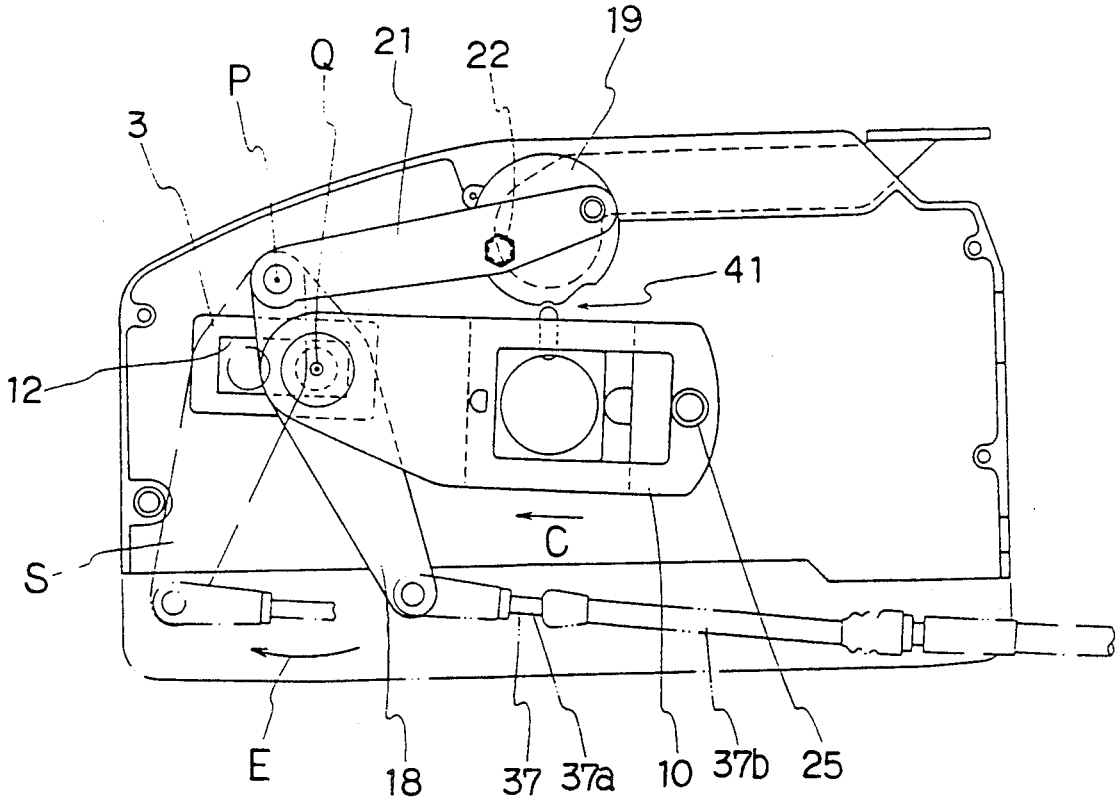
FIG. 3 and FIG. 4 are interior front views of the mechanisms shown in FIG. 1 and FIG. 2, respectively.

When the above-mentioned clutch operation is performed, the cam roller 35 moves in the rest zone Ro, therefore the operating plate 10 and the throttle arm 18 of FIG. 3 do not move.

When the clutch operation is finished, the inwardly curved slidable surface 36 located in the base part of the clutch arm 34 comes in contact with the cylindrical surface of the driving disc. Therefore, though widely the operational lever is swung, the clutch arm 34 does not rotate and is locked with keeping the angle. Such a clutch operation is almost the same as operation of a conventional device, including a lock mechanism.

When the operational lever is moved further in an arrow A direction, the cam roller 25 is admitted in the forward zone Rf of the cam groove 30, and the operating plate 10 is slided in the direction of an arrow C according to the rotating angle.

Therefore, the throttle arm 18 is rotated around the connecting point P in an arrow E direction, and the engine is accelerated through pulling the throttle cable 37 (referring to two-dot chain line S). And besides, during all that time, another connecting point Q connecting the throttle arm 18 with the operating plate 10 moves linearly, and the connecting point P moves somewhat up and down with respect to a point connecting the rotating link 19 with transmission link 21 (the position of the screw hole 22). For this reason, the down end of the throttle arm 18 has a narrow or range of up and down motion (the range for the same operating stroke) compared with the case of merely turning around the connecting points P or Q. Therefore, there is an advantage that a connecting rod 37*a* and a guiding pipe attached to an end part of the throttle cable 37 moves with a narrow angle.

The operation to return the operational lever to the original "neutral" position and the operation to rotate the lever in the aft side direction are the same as the above-mentioned "forward operation" except that the direction is inverse. Hereinafter, the free throttle operation in case of an idling running is explained referring to FIG. 1.

When the operational lever 29 is let to be in the state of neutral and the clutch is let to be in "neutral", the operating plate is in a regular position or a rest position (a position shown at right side of FIG. 1 with a real line).

Under the situation, when the throttle lever 20 is pulled in an arrow U direction, the rotating link 19 turns in the same direction and the transmission link 21 is pulled in the aft side direction (in an arrow T direction) as shown in an imaginary line. Then, the lower side of the throttle arm 18 rotates forward around the connecting point Q to pull the throttle cable 37. As a result, an idling running of the engine can be performed.

Though, the case that the device is mounted on a "pull-type-engine" is mentioned above, the device of FIGS. 1 and 2 can be easily applied to the "push-type-engine" by re-assembling as mentioned below.

Firstly, the connecting point of the transmission link 21 with the rotating link 19 is changed to the side of the screw hole 23. For that reason, the device becomes to a type that when the free throttle lever 20 is pulled and raised, the transmission link 21 is pushed forward.

Further, the cam roller 25 of the operating plate 10 is removed and is attached to a attaching hole (26 in FIG. 1) to be engaged with a cam groove 31 of the driving disc 8 of FIG. 2. For that reason, the operating plate 10 and connecting point Q are located in the left side in the neutral position. Therefore, when the transmission link 21 is pushed forward, the lower side of the throttle lever 18 is rotated backward and the throttle cable 37 is pushed. Then the engine can be accelerated.

Next, in relation to the throttle operation by means of the operational lever 29, when the operational lever 29 is operated so as to be turned forward, the cam roller 25 comes into the ahead zone Rf and the operating plate 10 is pulled backward to the full throttle position. Then the throttle arm 18 is rotated in the aft direction.

Figure 5:
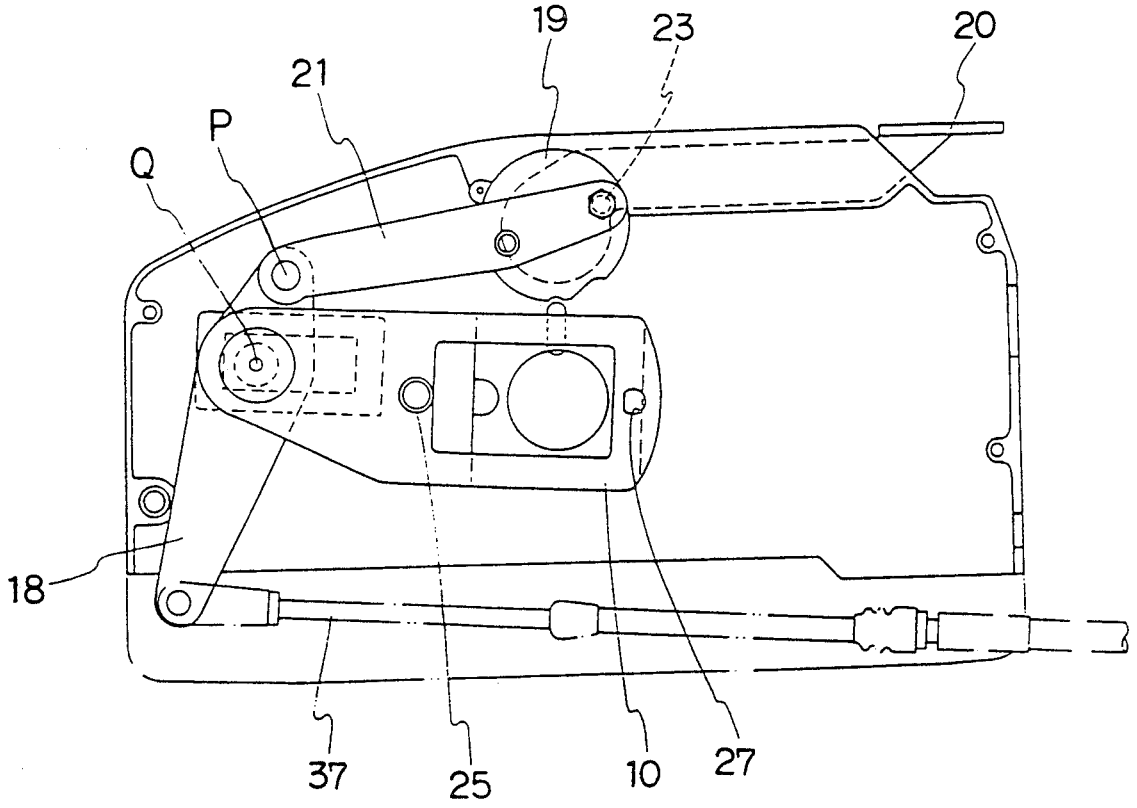
FIG. 5 is a front view showing the device shown in FIG. 1, in the re-assembled state for pull-type-engine.
Figure 6:
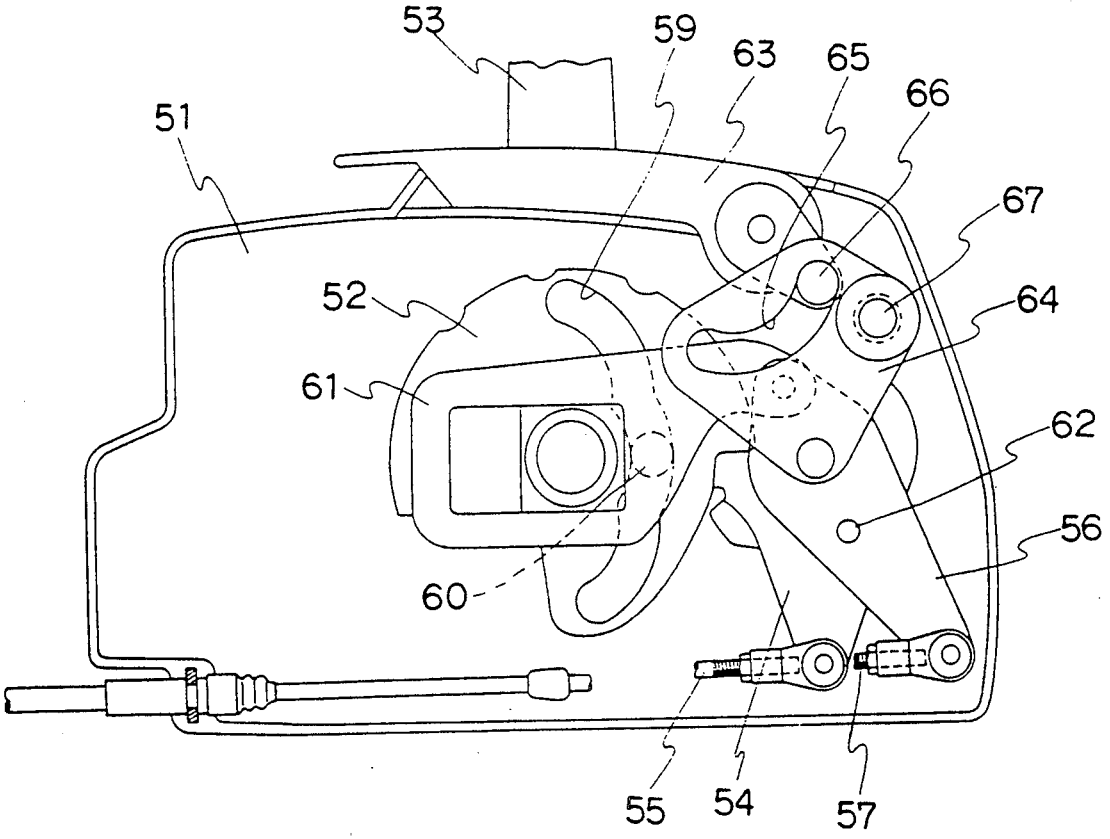
FIG. 6 PRIOR ART
FIG. 6 is a front view showing an inner part of an example of conventional engine control apparatuses for marine use.

Therefore, in case that the device is re-assembled as shown in FIG. 5, the throttle cable 37 can also be pushed either pushed to the accelerating side or pulled to the decelerating side operation by means of the operational lever 29 and the free throttle lever 20 through the same manner as the explanation in case of FIG. 3.

Also in the device of the present invention, it is preferable that the device has a braking means (40 in FIG. 4) for giving a feeling of a suitable resistance against the motion of the operational lever as are in the conventional device and has a known interlocking mechanism 41 in FIG. 3 for preventing an errorneous simultaneous operation of the operational lever 29 and the free throttle lever 20, as are provided in the conventional device.

Further, the device may preferably have a suitable detent mean for announcing a certain angle position (the end of rotating and so on) of the driving disc 8 and the rotating link 19 to the operator.

Besides, if a through hole is formed in the housing cover 1, a boss part of the operational lever 29 can be advantageously fixed to the top end of the boss 9 of the driving disc 8 through the hole. For that reason, the operational lever can also be easily attached to the housing cover side.

When the device of which the operational lever is attached to the housing cover side and another type of device of which the operational lever is attached to the housing body side are superposed together, the device can be employed as an operating apparatus for a motorboat having two engines so as to speak a "twin-type-motorboat".

Moreover, the numeral 43 of FIG. 4 shows an ignition key switch, and the numeral 44 shows a terminal for the purpose of connecting to electric apparatuses, for example, a limit switch for detecting an angular position of the driving disc, a trim switch (a switch for operating a trim angle of an outboard engine) attached to the operational lever.

Further, the numeral 29*a* of FIG. 1 shows a lever connected to a trigger which is attached to a grip of the operational lever 29. The lever 29 allows itself to turn (or change to an operating position) only when the trigger is pulled with a finger, and is used for the purpose of releasing an interlock of the operational lever.

The device of the present invention retains the operatability to change the clutch and to operate the throttle with a single operational lever at the same time that a conventional device has. In addition, in the device of the present invention since the mechanism is simple, assembling and maintenance are easy. Further, the device is also selectively applied to "pull-type-engine" and "push-type-engine" by re-assembly some parts.

Though several embodiments of the invention are described above in detail, it is to be understood that the present invention is not limited to the above-mentioned embodiment, and various changes and modifications may be made in the invention without departing from the spirit and scope thereof.

What is claimed is:

1. An engine control apparatus for marine use comprising:

(a) an operating plate movable in a substantially straight moving direction;

(b) a driving disc having a cam for substantially linearly driving said operating plate;

(c) a transmission link arranged so as to extend in the moving direction of said operating plate and to be movable in the moving direction;

(d) a free throttle lever for causing pushing/pulling operation of said transmission link; and (e) a throttle arm connected to said transmission link at a first rotation center and connected to said operating plate at a second rotation center, wherein when a throttle is operated through the operating plate, the throttle arm rotates around the first rotation center; and when the throttle is operated through the free throttle lever, the throttle arm rotates around the second rotation center.

2. The apparatus of claim 1, wherein said operating plate is attached to a housing cover and is guided linearly; and a base end of said transmission link is pivotally supported with a free end of a rotating link which is rotatably provided to the housing cover.

3. The apparatus of claim 2, wherein said driving disc has a cam for pull type and another cam for push type, both cams being formed in the driving disc so as to be mutually opposed with respect to a rotating center of the driving disc, wherein a cam roller attached to the driving disc is selectively attached to a position where the cam roller is engaged with the cam for push type or the cam for pull type, and wherein two pivotally supporting positions of said rotating link with said transmission link are formed in two places which are substantially symmetrical with each other with respect to a rotating center of the rotating link.

* * * * *